US005123888A

United States Patent [19]

Fainberg

[11] Patent Number: 5,123,888

[45] Date of Patent: Jun. 23, 1992

[54] PAIL BOX MACHINERY

[76] Inventor: Abram Fainberg, 7 Roger Williams Green, Providence, R.I. 02904

[21] Appl. No.: 697,254

[22] Filed: May 8, 1991

[51] Int. Cl.[5] ..... B31B 3/44; B31B 3/86; B31B 3/88

[52] U.S. Cl. ..... 493/53; 493/88; 493/125; 493/167

[58] Field of Search ..... 493/53, 88, 122, 123, 493/124, 125, 126, 127, 167

[56] References Cited

U.S. PATENT DOCUMENTS

| | | | |
|---|---|---|---|
| 1,001,198 | 8/1911 | Haas | 493/88 |
| 1,038,145 | 9/1912 | Inman | 493/88 |
| 1,509,191 | 9/1924 | Craig | 493/88 |
| 1,509,192 | 9/1924 | Craig | 493/88 |
| 1,511,320 | 10/1924 | Craig | 493/88 |

OTHER PUBLICATIONS

Saranac Machines (Bulletins), Benton Harbor, Mich., USA 1932 Folding Paper Boxes (Dealers Price List) Standard Box Co., Chelsea, Mass. USA.

Saranac Machines for Paper Board Containers (Bulletin PC), Benton Harbor, Mich., USA.

*Primary Examiner*—William E. Terrell

[57] ABSTRACT

There are provided here a hand-operated and automatic machines for producing pail boxes from pre-made blanks of paper and wire handles bonded together in the form of a bar, and a machine for producing wire handles. The hand operated pail box machine includes a folding assembly, clinching mechanisms for attaching a wire handle to the folded box, a wire handle conveyor and levers for driving machine by the user himself. The hand-operated machine has such small dimensions that several of these machines can be installed one on the other in a unit for producing pail boxes of different sizes. The automatic pail box machine in addition to said hand-operated machine, is equipped with a blank storage assembly, a feeder for feeding box blanks, a receiver for made boxes, and a mechanical drive. The machine for making handles from a continuous strip of plurality of parallel metal wires bonded together includes as frame, three pairs of columns with punches, two bed dies, a strip feeding mechanism, and a strip cutting mechanism. The machine is to be driven continuously. The cut off wire strip is then bent and moved off the machine.

18 Claims, 5 Drawing Sheets

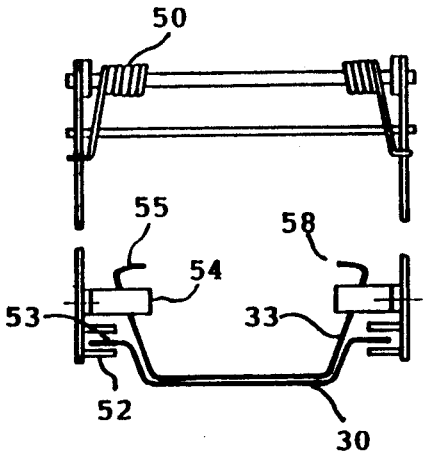
FIG. 5
FIG. 6a
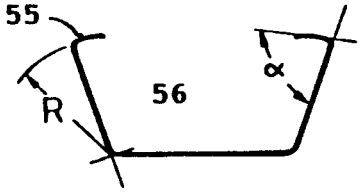
FIG. 6b
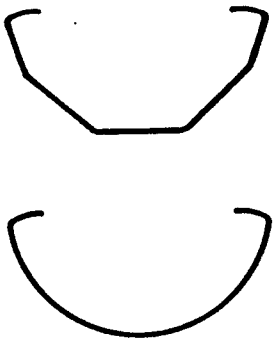
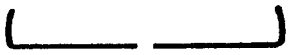
FIG. 6d
FIG. 6c
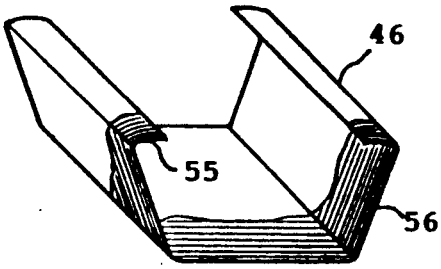
FIG. 13
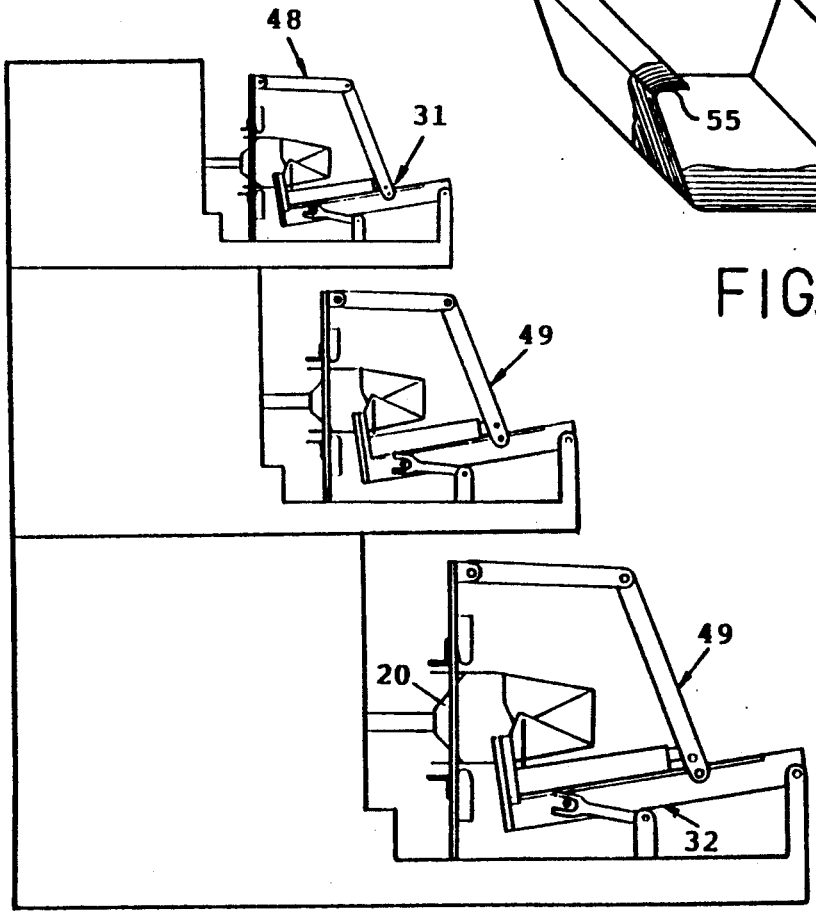
FIG. 7

PAIL BOX MACHINERY

This invention relates to machinery for making paperboard containers and, more particularly, to machines for making boxes with handles, preferably from wire. A well known semi-automatic machine made by Saranac Co. produces boxes with handles made from coil of wire. In these machines, prepared blanks are automatically fed by conveyor. The machine then folds, forms, attaches wire handle from a wire coil, ejects, nests and counts the boxes. Finished boxes are delivered in packages of needed quantity to users. This method of producing boxes by machines of Saranac type has a number of imperfections which have kept the pail box from wider use:

a. Pail boxes are more expensive relative to other types of boxes with same purpose;
b. There are problems in automatically separating boxes one from another;
c. Boxes are subject to damage during transportation and storage;
d. Present machinery, designed for production of pail boxes in a factory, can't be installed in automatic production line for goods;
e. There are problems with advertising the user's name and packing the box with goods.

Generally stated, the object of the invention is to provide a novel construction, whereby boxes with wire handles can be made in a rapid and efficient manner on a hand-operated machine directly in restaurants, stores, small production companies, etc. by using blanks of paper and pre-made wire handles. To make a box a user must put a blank made of paper or other suitable material in the machine, then pull and turn the levers. The entire operation takes only 2-3 seconds, no longer than stapling sheets of paper together.

Several of these machines with space for storage blanks and wire handles can be stacked one on top of another in several levels for production of different size boxes in one single unit. The energy needed for folding a blank of paper and attaching a wire handle is so small that the machine can be driven merely by the hand of the operator.

Another object of the invention is to provide a novel construction whereby the machine for making pail boxes can be installed as part of an automatic line for packaging with goods. And a still further object is to provide a novel construction for producing box handles in the form of bars from a continuous strip of plurality of metal wires bonded together. Then handles can be stored and used as needed. It is also an object to provide certain details and features of construction and combinations which would increase the general efficiency and desirability of pail box and wire handle machines.

In order that the invention and objects thereof may be readily understood and put into practice, reference will now be made to the various figures of the drawings in which:

FIG. 5 is an enlarged sectional view taken along lines 5—5 of FIG. 1;

FIG. 6*a* is a progressive shape of the wire handle; FIGS. 6*b*-6*d* are modifications of FIG. 6*a;*

Figure 8:
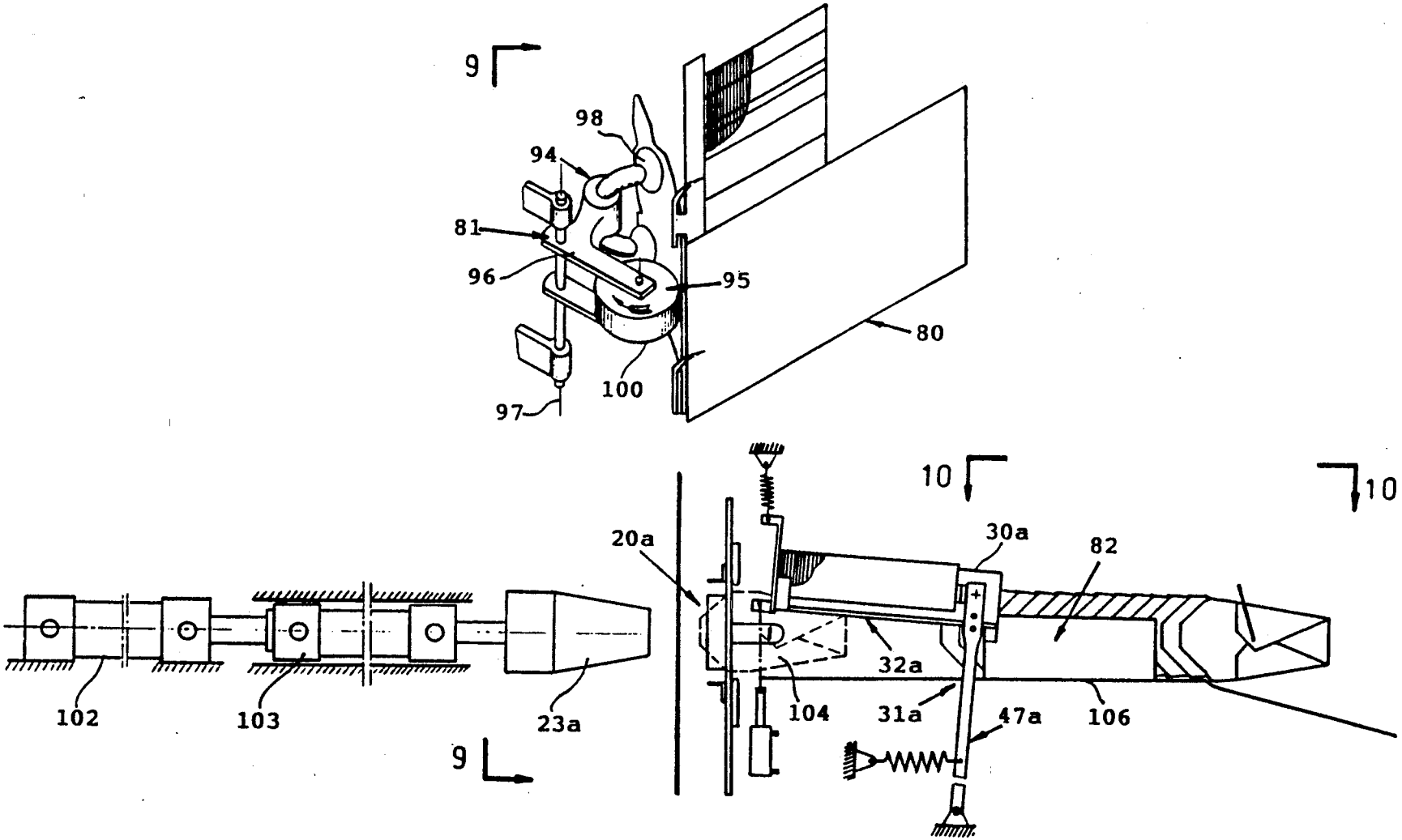
Figure 9:
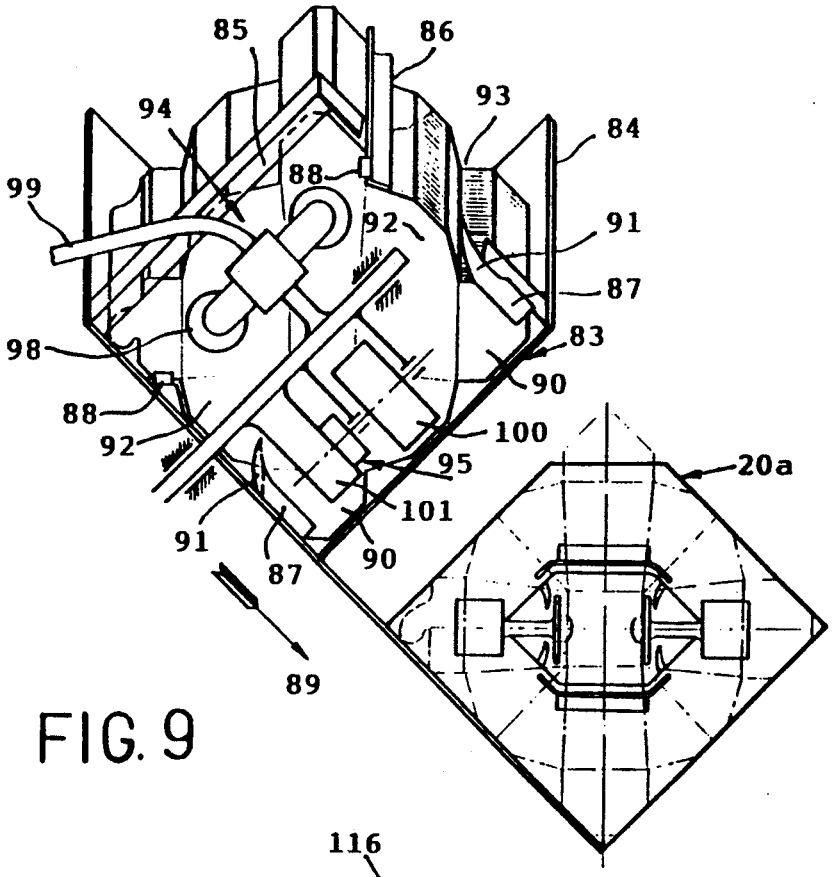
Figure 10:
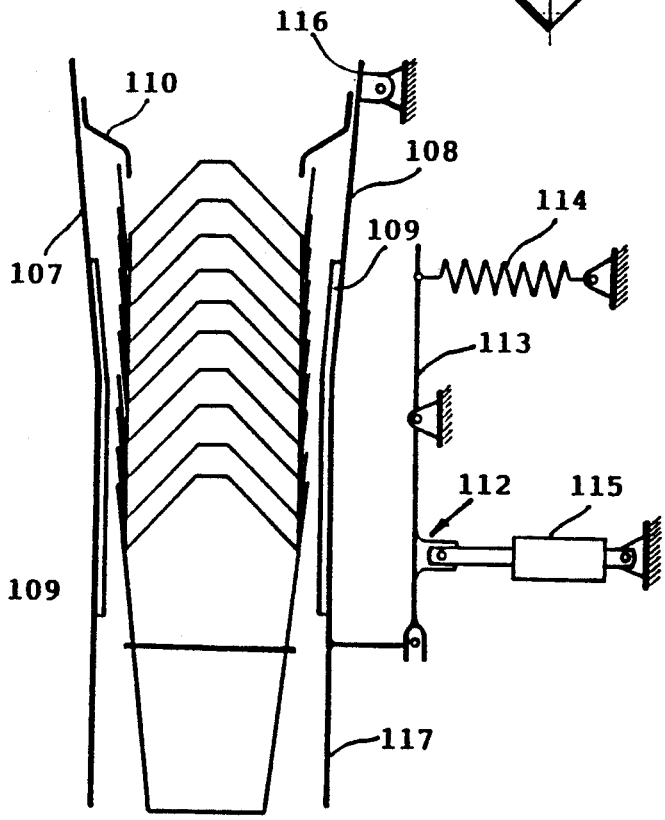
Figures 11, 12, 14A, 14B, 14C, 15A, 15B, 15C:
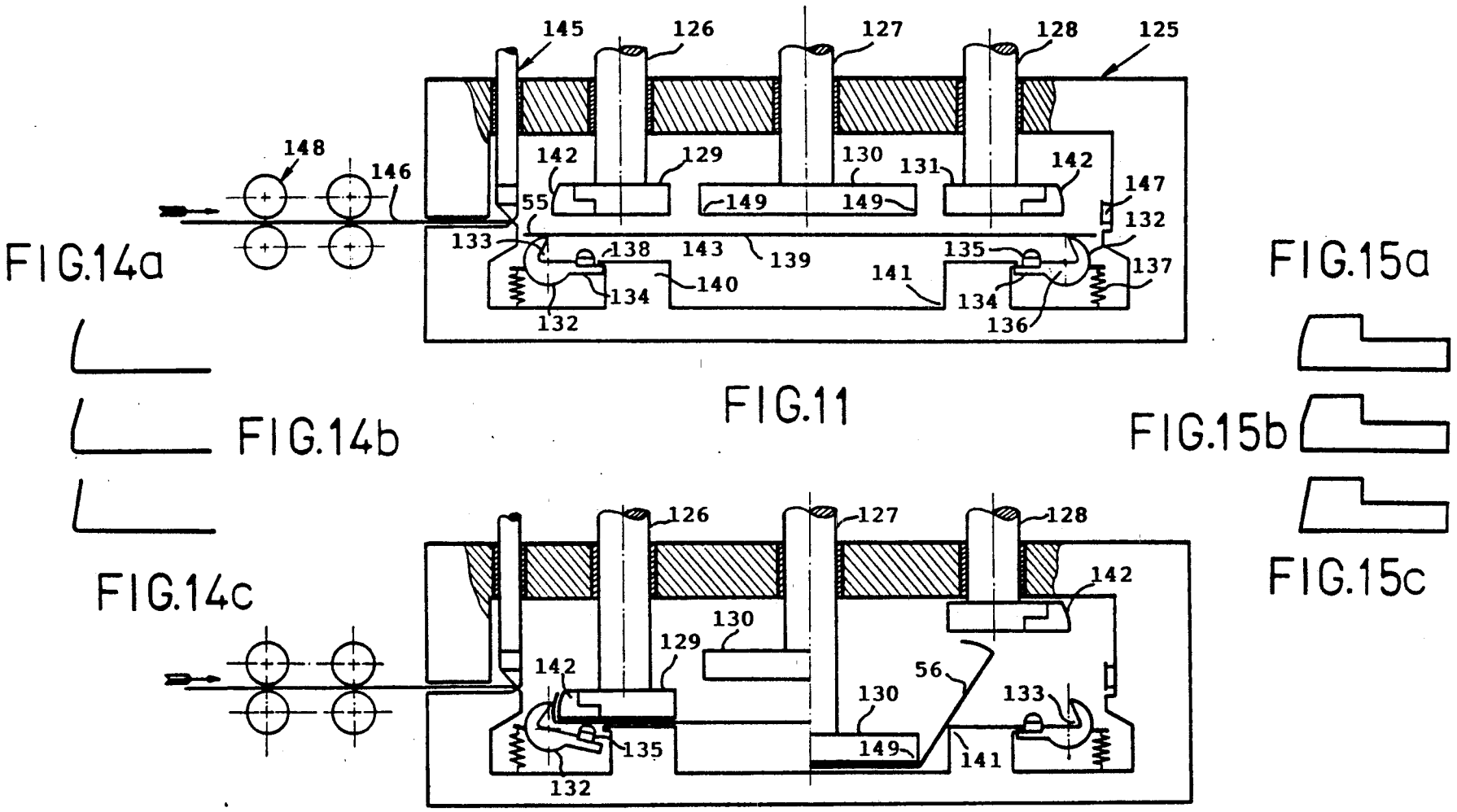

FIG. 7 is a fragmentary side elevation view showing a unit of a hand-operated pail box machines for making three different sizes of boxes;

FIG. 8 is a somewhat diagrammatic view of an automatic pail box machine;

FIG. 9 is a fragmentary front elevation view showing some of the blank storage, feeding blanks mechanism and the folding assembly taking along lines 9—9 of FIG. 8;

FIG. 10 is an enlarged fragmentary schematic top view of the receiver for storage of the produced boxes taken along lines 10—10 of FIG. 8;

FIG. 11 is a fragmentary side elevation view, partially in section, showing a machine for making wire handle bars in position before bending the wire strip piece;

FIG. 12 is a fragmentary side elevation view similar to FIG. 11 showing on the left hand side the machine in position for bending the ends of the wire handle bar and on the right hand side for completely making said wire handle bar;

FIG. 13 is a perspective view of a wire handle bar;

FIG. 14*a* is an enlarged fragmentary view of a progressive form of the wire handle ends in FIG. 6 *a;*

FIGS. 14*b* and 14*c* are modifications of FIG. 14*a;*

FIGS. 15*a*-15*c* are enlarged views of the punch nozzles for ends bending of the wire handle accordingly of FIGS. 14*a*-14*c*.

HAND-OPERATED PAIL BOX MACHINE

Figure 1:
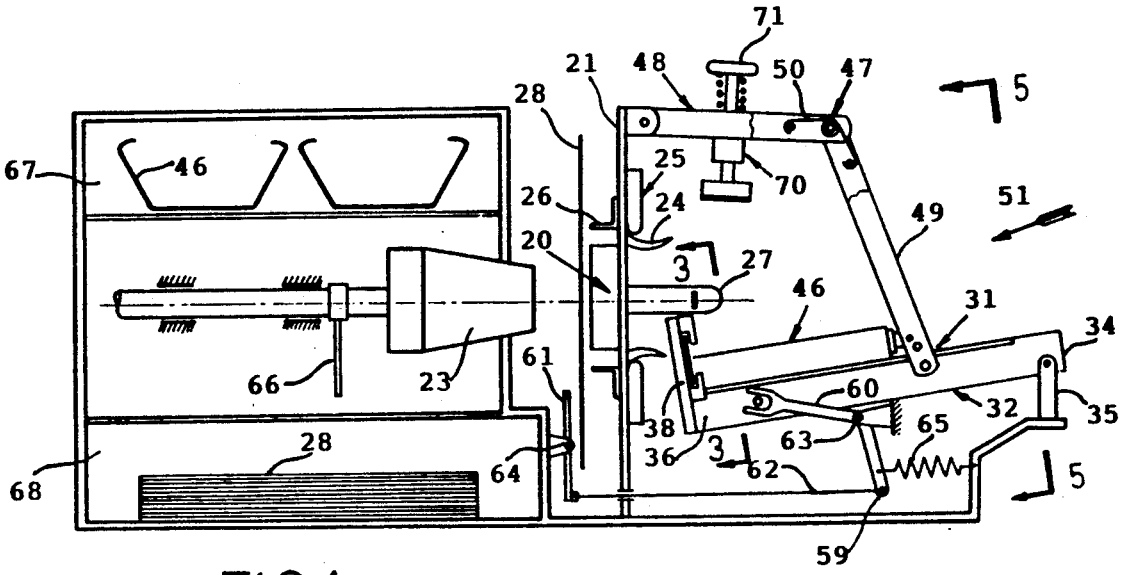
FIG. 1 is fragmentary side elevation view, partially in section, showing a hand-operated pail box machine.
Figure 2:
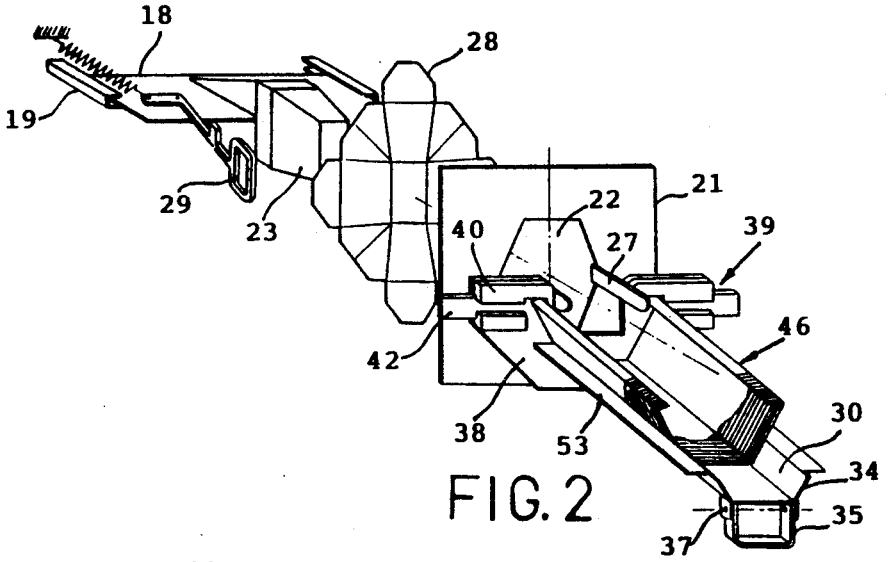
FIG. 2 is a fragmentary perspective view of the hand-operated pail box machine of FIG. 1.

The hand-operated pail box machine for making boxes directly by users in restaurants, stores, small production companies, etc. as shown in FIGS. 1 and 2 includes piston 23 and folding means 20 with plurality parts mainly base plate 21 with opening 22, four folders 24, two die assemblies 25, two members 26 and two lugs 27. The folders 24, die assemblies 25, members 26 and lugs 7 are mounted to the base plate 21 around the opening 22. When piston 23 is pulled through opening 22 blank 28 of paper (or other suitable material) the blank is folded to form a box as is common and well known in machinery of this kind. The piston 23 and two levers 29 (shown only one) are attached to the horizontal member 18 which is slid in guides 19. The shape of the piston 23 may be conical or rectangular depending on application. If the made boxes are to be stored before using, the shape must be conical, i.e. tapered for packing one in the other, as is the case in present machines. But if the made boxes are produced for direct filling with goods, the shape may be rectangular. The wire handle conveyor 31 for conveying wire handles 33 to the place for attaching to the folded box comprises handle container 32 and pushing means 47. The base of the container 32 is U-shaped member 30 for placing inside wire handles 33. The rear end 34 of the container 32 is pivotally mounted to the bracket 35 of the frame and its forward end 36 is raised and lowered about the horizontal axis 37. The container 32 has two shoulders 53 for connecting with the pushing means 47 and a plate 38 on which are mounted two clinching mechanisms 39. The pushing means 47 is provided for moving handles 33 in the handle container 32 to the clinching mechanisms 39. Basically, the pushing means 47 comprises passive link 48 and active link 49 joined together. The free end of the passive link 48 is connected with the plate 21. By spring 50, the link 49 is loaded in direction of arrow 51. The bottom end of the link 49, as will be seen in FIG. 5, has two pairs of fingers 52 for connecting with the shoulders 53 of the handle container 32, and pivotally attached pushers 54. In the process of work, the pushing means 47 is swinging up-down together with handle container 32 providing permanent pressure on the handles 33 towards the clinching mechanisms 39.

Figure 3:
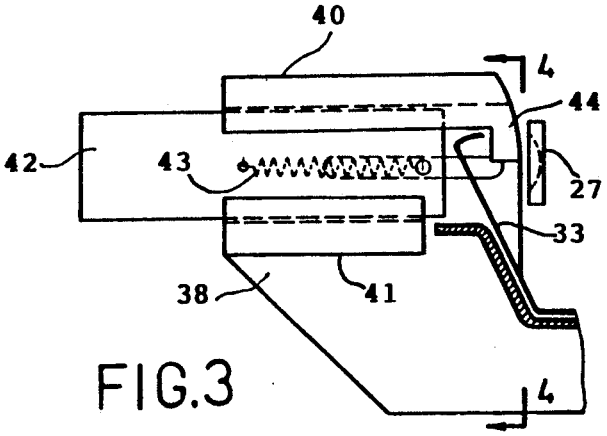
FIG. 3 is an enlarged cross-section view of the handles container with portions broken away taken along lines 3-3 of FIG. 1.
Figure 4:
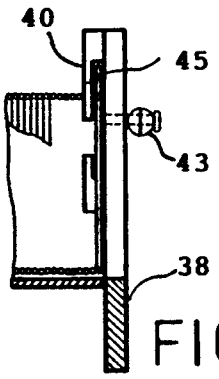
FIG. 4 is a sectional view taken along lines 4—4 of FIG.3.

Each clinching mechanism 39, as is best shown in FIGS. 3 and 4, includes guides 40 and 41 secured to the plate 38, clincher 42 and spring 43. The guide 41 is shorter then the guide 40 for adjoining the handles 33. The lug 44 of the guide 40 with the plate 38 forms a gauged slot 45 for sliding through just one wire handle Clincher 42 has the same thickness as the diameter of the wire handle 33 and as a result the clincher 42 selects each time only one handle and pushes it through the slot 45 to attach it to the folded box. The spring 43, as will be understood from FIG. 3, returns clincher 42 to the initial position to let the new handle adjoin with plate 38.

The wire handle 33, the prefered form of which is best shown in FIG. 6*a*, has two bent ends 55 about 0.62 inches in length that form between leg 56 and bent end 55 an angle $\alpha$ equal to or less than a right angle. In order to protect the folded box, the bent ends 55 are bent on a circle with radius R equal to the length of the leg 56. All bends of the handle 33 are accomplished on the same plane. For convenience in maintenance, the handles 33 are bonded together to form a bar 46, as shown in FIG. 13. The ends 58 of the handles are sharpened for easy attaching to the folded box. In FIGS. 6*b*, 6*c*, 6*d*, 14*b* and 14*c* are shown other forms of handles and shapes of the bent ends.

The process of making boxes is provided by raising and lowering the forward end 36 of the handle container 32. In raised position the handles are attached to the folded box and in lowered position the completed box can be moved off the machine. The pivotally reciprocating movement of the handle container 32 relative to the axis 37, as will be seen in FIG. 1, is provided by lifting mechanism 59 which includes two rockshafts 60 and 61, connected one to the other by flexible cable 62, and swinging in corresponding axles 63 and 64, returning spring 65 and claw 66. When the piston 23 with claw 66 moves to the folding assembly 20, the claw 66 turns the rockshaft 61. The rockshaft 61, through flexible cable 62, turns the rockshaft 60, which raises the handle container 32. After piston 23 with claw 66 is moved back by operator, the spring 65 returns all moveable parts of the lifting mechanism 59 to the initial position.

For making a box the user must:

a. Put a box blank in the machine;

b. Pull levers 29 (FIG. 2) completely (in this time the piston 23 will fold the blank and the lifting mechanism 59 will raise the end 36 of the handle container 32);

c. By levers 29, push the clinchers 42, which will attach handle to the folded box;

d. Return levers 29 back to initial position (the end 36 of the handle container 32 will be lowered to allow removal of the completed box).

The entire operation take just 2–3 seconds, no longer than stapling sheets of paper together As will be seen from FIG. 1, the machine is to be provided with two spaces 67 and 68 for storage box blanks 28 and handle bars 46. As shown in FIG. 7, the machines like in FIG. 1 can be stacked one on top another in several levels for production of different size boxes in one single unit. The energy needed for folding the blank of paper and attaching the wire handle is so small that the machine can be driven by user himself.

The hand-operated machine for advertising the user's name and packing goods in the box is equipped with printing means 70 which can be carried out by any simple printing mechanism well known in the art, for example, by the stamping type. Before the made box is taken off, the operator must push button 71 to print the needed information on the outside surface.

AUTOMATIC PAIL BOX MACHINE

FIG. 8 shows an automatic pail box machine according to another embodiment of the invention. This machine, when compared to machines available today, needs much less space, is much simpler to use, cheaper to construct, uses pre-made handles and as a result can be installed as part of an automatic production line for packing with goods.

Like the hand-operated machine in FIGS. 1 and 2, the automatic machine comprises a folding means 20*a*, wire handle conveyor 31*a*, and two clinching mechanisms (not shown). In addition, the automatic machine is equipped with drive mechanism (not shown), blank storage 80, means for feeding box blanks 81, receiver means 82, and certain structural features of an automatic machine. The machine is intended to be driven continuously, and therefore most movable parts of the machine move in timed or synchronized relationship which may be obtained by means of any conventional driving and synchronizing mechanisms well known in the art, and therefore not described in detail in this specification. For example, the drive mechanism can be operated by a program control unit which has a number of adjustable cam discs. These cam discs are mounted on a shaft one rotation of which corresponds to one cycle of the machine. The cam discs operate successive valves, allowing air power energize the actuators of the machine.

The blank storage 80, as will be understood from FIGS. 8 and 9, is placed in a position which allows for gravity movement of the selected blank to folding position. The storage 80 includes frame 83 with two inclined planes 84, restricter 85 which supports the rear side of the blanks in their direction of travel, a pair of holders 86, and a pair of guides 87. The holders 86 are strait and each one has a lug 88 for preventing spontaneous discharge of blanks out and in the direction of arrow 89. The guides 87 support the forward side of the blank 28 in portions 90 and each one has a divider 91 which turns inside of the storage 80 in the groove 93 between portions 90 and 92 of the blanks. The angle on which the divider 91 turns is smooth and when the next blank is pushed in the direction of the arrow 89 the portions 92 of the blank will slide on the outside surfaces of the guides 87. This arrangement reduces the distance the blank travels and allows for installation of the blank storage 80 close to the folding assembly 20*a*.

Feeding blanks from storage 80 is done by means 81 which includes pulling assembly 94 and drive assembly 95, which are attached on opposite sides of the bracket 96 and swing around the axis 97. The pulling assembly 94 comprises two caps 98 for gripping blanks, valve with flap for intermittently directional vacuum to the caps (not shown), and vacuum system having flexible hose 99 and vacuum source (not shown). When the pulling assembly 94 moves ahead to the storage 80, the flap of the valve (not shown) turns in order to connect the caps 98 with the vacuum system. After the caps 98 touch and grip the next blank, the pulling assembly 94 swings in the opposite direction. In this backward motion the blank is partialy pulled from storage 80 and released from the restricter 85 and the lugs 88. In the next moment the caps 98 are disconnected from the vacuum system and the rear side of the blank is released. At this point the pulled blank is held in storage 80 only by guides 87. Since the pulling assembly 94 has moved back, the drive assembly 95 moves ahead and its rotation roller 100, which may be driven by motor 101, pushes the blank to the folding assembly 20*a*. In this motion, the blank completely lives storage 80 after its portions 90 pass the guides 87. Thus, each blank is released from the restricter 85 and lugs 88 by the pulling assembly 94, and pushed by the drive assembly 95 to the area for folding. As will be seen from FIG. 8, the piston 23*a* has two motions forward to the folding assembly 20*a* and one back. The motions of the piston 23*a* are provided, for example, by two air cylinders 102 and 103. In the first forward motion by cylinder 103, the piston 23*a* folds the blank and stops in the space 104 for attaching a wire handle. In the next forward motion by cylinder 102, the piston 23*a* together with cylinder 103 moves the made box to the receiver means 82 so that a handle may be attached to the next box.

In the case where the pail boxes are produces for storage, the receiver means 82, as shown in FIGS. 8 and 10, includes bottom sheet 106, two walls 107 and 108, the inside surfaces of which are covered with friction material 109, remover 110 for removing the made boxes from the piston 23*a*, and means 112 for releasing made box batches, including rockshaft 113, spring 114, and actuator 115. The wall 107 is rigidly fixed to the frame of the machine (not shown), but the wall 108 is pivotally mounted by one end 116. Its other end 117, through rockshaft 113, is loaded by spring 114 to render resistance in the motion of the made boxes. And as a result, the boxes are tightly packed one in the other. When the made boxes reach the desired quantity, the actuator 115 will be activated to release the made batch. In other cases where the pail boxes are produced for packing with goods, the receiver means 82 represent merely an elbow (not shown), in which the made box is moved by gravity to fall in vertical position on a conveyor of the automatic line.

For feeding handle bars 46 while the machine is working, the handle container 32*a* is installed above the piston 23*a* and its U-shaped member 30*a* is turned over relative to the member 30 in FIGS. 2 and 5 of the hand-operated machine. So, the wire handles in this case are attached to the folded boxes from above.

HANDLE BAR PRODUCING MACHINE

With reference to FIGS. 11 and 12, the machine for making box handles 33 from a continuous strip of a plurality of parallel metal wires bonded together includes a frame 125 in suitable bearings of which are slid verticaly three pairs of columns 126, 127 and 128 with corresponding punches 129, 130 and 131. To the punches 129 and 131 are clamped changeable nozzles 142 shaped preferebly as shown in FIG. 15*a*, or may be as shown in FIGS. 15*b* and 15*c*. Each of the two dies 132 has a groove 133 and shoulder 134 with lug 135. By spring 137, the die 132 is urged to turn in the axis 136 toward the stop 138. The top of the lug 135 has a spherical or like shape for gently sliding on the back side of the strip piece 139. Inside of the frame 125, there are two blocks 140 with corners 141 for bending the legs 56 of the handle bar 46 (FIGS. 12, right hand side, and 13) and a stop 138 for securing the bed dies 132. The machine is equipped with a severing mechanism 145 for severing the continuous strip 146 which is operated by switch 147, and with strip feeding mechanism 148. The columns 126, 127 and 128, the strip severing mechanism 145 and the strip feeding mechanism 148 are moved in a timed or synchronized relationship which may be obtained by means of any conventional driving and synchronizing mechanism well known in the art, and therefore not describe in detail in this specification. As will be seen from FIG. 11, the strip piece 139 is in the bent position. At this point, the columns 126 and 128 with punches 129 and 131 are moving down to bend both ends at 90°. In its futher motion to the rest 143 of the blocks 140, as shown in FIG. 12 left hand side, the bottom surface of the strip piece 139 reaches the lugs 135 and turns the bed dies 132 to bend the ends 55 (FIGS. 12, left hand side, and 13) to fit the selection nozzle 142. In the next sequence of operation, the columns 126 and 128 move up and at the same time the column 127 with the punch 130 moves down to bend legs 56 at the corners 141 and 149 of the blocks 140 and the punch 130 accordingly. After this operation is done, the handle bar 46 (FIG. 13) is ready and by any suitable actuator is extracted from the machine in a direction perpendicular to the plane. And later, after feeding and severing a new strip piece 139, the cycle of making a new handle bar 46 is repeated.

I claim:

1. A hand-operated machine for making pail boxes by the user himself from pre-made blanks and wire handles, comprising:

a frame having guides, a folding means for defining a box forming die, a piston means slidable along a longitudinal axis in the guides of said frame for pushing a blank through said folding means to form a box, a pair of clinching mechanisms for clinching a wire handle onto the formed box;

a conveyor means for conveying said wire handles to the clinching mechanisms, comprising a handle container with a rear end pivotally attached to said frame for pivotal movement about a transverse axis, and pushing means including a link mechanism secured to said folding means and cooperable with said handle container for exerting a continuous force on said wire handles for moving them to said clinching mechanisms, said conveyor means being adapted to supply the wire handles in the form of a bar of bonded handles each having two bent ends for attachment to said folded box, said pair of clinching mechanisms being rigidly attached to the forward end of said handle container, said clinching mechanisms each including a gauged groove and a clincher for selecting a pushing through said groove only one said handle per cycle and attaching it to the folded box, and means to pivot said handle container about said transverse axis to alternately align and displace said handle container relative to said longitudinal axis for attaching said handle to said folded box in its aligned position and facilitating removal of a completely made box in its displaced position.

2. The hand-operated machine of claim 1 wherein said handle container comprises a U-shaped member having a pair of laterally spaced longitudinal shoulders for connecting with an active link of said pushing means to provide the continuous force on said handles towards said clinching mechanisms.

3. The hand-operated machine of claim 1 wherein said piston means includes a piston with a tapered shape for producing boxes which can be nested one in the other for storage.

4. The hand-operated machine of claim 1 wherein each handle has a leg and the angle between the leg of said handle and said bent end is equal or less than right angle, with each bent end being approximately 0.62 inches in length.

5. The hand-operated machine of claim 1 futher including space for storing said blanks and space for storing handle bars.

6. The hand-operated machine of claim 1 futher including a print means for printing on the outside surface of the made box advertising information about the company and the goods.

7. The hand-operated machine of claim 1 in combination with another said hand-operated machine each to produce different size boxes, stacked one on top another in several levels in one single unit.

8. An automatic machine for producing pail boxes from pre-made blanks and wire handles, comprising:

a frame having guides, a folding means for defining a box forming die, a piston means slidable along a longitudinal axis in the guides of said frame for pushing a blank through said folding means to form a box, a pair of clinching mechanisms for clinching a wire handle onto the formed box;

a conveyor means for conveying said wire handles to the clinching mechanisms, comprising a handle container with a rear end pivotally attached to said frame for pivotal movement about a transverse axis, and pushing means including a link mechanism secured to said folding means and cooperable with said handle container for exerting a continuous force on said wire handles for moving them to said clinching mechanisms, said conveyor means being adapted to supply the wire handles in the form of a bar of bonded handles each having two bent ends for attachment to said folded box, said pair of clinching mechanisms being rigidly attached to the forward end of said handle container, said clinching mechanisms each including a gauged groove and a clincher for selecting and pushing through said groove only one said handle per cycle and attaching it to the folded box, and means to pivot said handle container about said transverse axis to alternately align and displace said handle container relative to said longitudinal axis for attaching said handle to said folded box in its aligned position and facilitating removal of a completely made box in its displaced position.

9. The automatic machine of claim 8 wherein said handle container comprises a U-shaped member having a pair of laterally spaced longitudinal shoulders for connecting with an active link of said pushing means to provide a permanent pressure on said handles towards said clinching mechanisms.

10. The automatic machine of claim 8 wherein said piston means includes piston with a tapered shape for producing boxes which can be nested one in the other for storage.

11. The automatic machine of claim 8 wherein each handle has a leg and the angle between the leg of said handle and said bent end is equal or less than right angle with each bent end being approximately 0.62 inches in length.

12. The automatic machine of claim 8 further comprising a blank storage positioned adjacent to said folding means for gravity movement of a selected blank to said folding means, said blank storage comprises a restricter for supporting rear side of the blanks in their direction of travel, two lugs for preventing spontaneous discharge of said blanks and two guides for supporting and guiding a forward side of said blanks.

13. The automatic machine of claim 12 wherein said guides each have a divider turned inside of said storage to provide a free motion of said selected blank after its said forward side passes said guides.

14. The automatic machine of claim 12, wherein said frame has a swinging bracket, and futher comprising a feeding means secured to the swinging bracket of said frame for feeding said blanks from said storage to said folding means, said feeding means including a pulling assembly attached to one end of said swinging bracket for pulling and releasing said rear side of the next blank from said restricter and said lugs of said storage, and a drive assembly attached to the other end of said swinging bracket for pushing said selected blank to said folding means.

15. The automatic machine of claim 8 futher comprising a drive means for driving said piston forward in two motions including one motion to said folding means for folding said blank and attaching said handle, and a second forward motion away from said folding means to provide a free space for making next box.

16. The automatic machine of claim 8 further comprising a receiver means for receiving made boxes, said receiver means having elbow means for turning said made boxes by gravity with their opening side upward.

17. The automatic machine of claim 8 futher comprising a receiver means for stacking made boxes one in the other for storage including a remover means for removing said made boxes from said piston and a number of fixed and pivotally attached members with friction surfaces for tightly packaging said made boxes.

18. The automatic machine of claim 17 wherein said stacking means includes actuator means for actuating when said boxes reach a batch of desired quantity.

* * * * *